United States Patent [19]

Hayes, Jr.

[11] Patent Number: 4,815,257

[45] Date of Patent: Mar. 28, 1989

[54] METHOD AND APPARATUS FOR CARTONING LOOSE MEDIA

[75] Inventor: Charles F. Hayes, Jr., Marshall, Mich.

[73] Assignee: HayesMachine Company, Inc., Marshall, Mich.

[21] Appl. No.: 120,347

[22] Filed: Nov. 13, 1987

[51] Int. Cl.[4] ..... B65B 39/14; B65B 39/12

[52] U.S. Cl. ..... 53/473; 53/236; 53/252

[58] Field of Search ..... 53/473, 252, 467, 236, 53/148, 531

[56] References Cited

U.S. PATENT DOCUMENTS

| | | | |
|---|---|---|---|
| 1,621,948 | 3/1927 | Ney . | |
| 2,631,767 | 3/1953 | Banks | 226/24 |
| 2,907,155 | 10/1959 | Engelson et al. | 53/63 |
| 3,269,091 | 8/1966 | Martin | 53/252 |
| 3,279,147 | 10/1966 | Garapolo | 53/252 |
| 3,453,800 | 7/1969 | Mahncke | 53/252 X |
| 3,465,493 | 9/1969 | Sandy | 53/252 X |
| 3,678,649 | 7/1972 | Clancy . | |
| 3,821,874 | 7/1974 | Jones | 53/27 |
| 4,211,054 | 7/1980 | Sramek | 53/502 |
| 4,386,490 | 6/1983 | Griffith et al. | 53/148 |
| 4,509,309 | 4/1985 | Langen et al. | 53/252 X |
| 4,578,927 | 4/1986 | Scarpa et al. | 53/506 |

*Primary Examiner*—Horace M. Culver

*Attorney, Agent, or Firm*—Price, Heneveld, Cooper, DeWitt & Litton

[57] ABSTRACT

A cartoning apparatus for loading loose media, such as spaghetti, vermicelli, or other loose, into a carton, wherein the apparatus is provided with bucket structures, platens, actuators, and a loading assembly which are all moved along parallel predetermined paths. The bucket structures include forward and rearward ends whereby the bucket structures may be translated such that the forward end may be disposed adjacent an aligned open carton, and the rearward end may receive loading assembly. Such rearward end is provided with a funnel structure which cooperates with a self-aligning pusher foot comprising part of the loading assembly to effectuate alignment and mating receipt of the pusher foot with a cavity defined by the bucket structure. The platen is preferably provided with indexing ears which are matingly received with corresponding indexing notches provided on the bucket structure for precisely positioning and holding of the platen in its proper position and orientation so that the media is maintained below a top surface of the carton.

22 Claims, 5 Drawing Sheets

METHOD AND APPARATUS FOR CARTONING LOOSE MEDIA

BACKGROUND OF THE INVENTION

The present invention pertains to cartoning apparatus, and in particular to apparatus for the cartoning of spaghetti, vermicelli or other loose product.

The placing of various goods into cartons or boxes is an integral function of many manufacturers. Systems designed for the cartoning of numerous types of goods have been developed to operate by means of conveyor apparatus in an assembly line fashion, so as to be easily and efficiently adapted to most manufacturing processes. Typically, the system involves a multiple-line parallel conveying process. A series of containers for receiving the goods, a series of cartons for packaging the goods and a series of pusher elements for transferring the goods from the container to the carton are all moved along parallel paths at the same rate and direction. The initial stages of the process entails feeding the goods into the container and opening the cartons which are previously in a flattened state. The equipment for opening the cartons necessarily travel along a parallel path with the cartons for a limited distance, and generally effect opening of the cartons through the use of air pressure directed in its one end to be opened. Hence, the opening equipment occupies a space between the containers and the cartons. This space, then, creates a gap between the containers and the cartons at the time of transfer, which could result in jamming, loss of the goods, etc. To alleviate this problem, past artisans have utilized a series of intermediate transfer elements which align with the containers and cartons and fill the gap to facilitate a more efficient loading procedure. Once the container, intermediate transfer element and carton are all aligned, the aligned reciprocal pusher element having a pusher foot engages and pushes the goods from the container, across the intermediate transfer element and into the awaiting open carton.

For most goods, these standard operations have been sufficient. However, when a loose media, such as spaghetti or vermicelli, is to be cartoned the standard systems are inadequate. Prior apparatus cannot effectively guard against the spilling of the loose media out of the top of the container or the escapement thereof along the sides past the foot member. Consequently, this results in the packaging of cartons which are not full, the jamming of the media into the machine parts, a waste of the media to be packaged and an increased build-up of debris in the processing plant.

One solution which has been developed which accommodates the mating receipt of the pusher foot into the container, such as is necessary with the cartoning of a loose media, is to fabricate the container and pusher foot as a matching set. More specifically, the pusher foot is specially made in conjunction with a particular container so that it will mate with the cavity of the container, and ensure that all of the loose product (e.g. spaghetti) are pushed into the carton. In this arrangement, the pusher foot is always positioned within the container to obviate the inherent alignment problems which would otherwise ensue. However, by utilizing such matched sets, the cost of manufacturing the system is increased. Also, replacement of either the container or pusher foot requires the fabrication of another complete set. This is accomplished by replacing the entire set with a new set which is an expensive procedure, or shipping the set away for the machining of a new mating element which may result in costly down time for the manufacturer.

SUMMARY OF THE INVENTION

The aforementioned problems are overcome in accordance with the present invention, wherein a cartoning apparatus is designed particularly for use in the packaging (i.e., cartoning) of spaghetti, vermicelli or the like, but which is also advantageous in the cartoning of other loose products.

An efficient and reliable packaging process is effectuated by a system based upon the interaction and cooperation of a container an upper platen and a loading or pusher assembly. These elements are self-aligning and indexed together to facilitate a loading process in which the loose products are quickly and efficiently loaded into the aligned carton without the inevitable spillage, breakage or loss heretofore experienced. Due to the self-aligning nature of the elements, the apparatus will therefore allow for chain stretch and tolerance buildup of the different elements of the assembly. This in turn permits the bucket structure and loading assembly, manufactured to close tolerances, to operate freely without the need for fabricating matched sets. Hence, the utilization of the system of the present invention reduces manufacturing and repairing costs.

As another aspect of the present invention, the system includes the moving of the bucket structure toward the carton so that it lies directly adjacent thereto immediately prior to the transferring of product into the carton. In this construction, the bucket structure's movement effectively eliminates the gap which normally exists between the cartons and the containers. Hence, the present invention completely eliminates the series of intermediate transfer elements heretofore required. Therefore, alignment concerns are greatly eased since the container need only align with the carton. Furthermore, the risk of jamming, damaging, etc., of the product being loaded into the carton are also substantially reduced. Moreover, by eliminating an entire conveyor system, the user not only streamlines the cartoning procedure but also substantially reduces the cost of maintaining the cartoning apparatus.

These and other objects, advantages and features of the present invention will be more fully understood and appreciated by reference to the written specification and appended drawings.

DETAILED DESCRIPTION OF THE PREFERRED EMBODIMENT

In accordance with the preferred embodiment, efficient and reliable loading of a specific quantity of loose, thin articles such as spaghetti, vermicelli or other loose product is accomplished through the interaction and cooperation of a bucket structure 12, an upper platen 14 and a loading assembly 16. Bucket structure 12 is moved along a predetermined path in alignment with a particular desired carton 18 suitable for retail purposes. Bucket structure 12 receives (from an overhead supply apparatus of a conventional nature, not shown) a measured quantity of the product for subsequent loading into carton 18. Immediately prior to the loading of the product into carton 18, bucket structure 12 is moved transverse to the path, so that it lies directly adjacent open carton 18. Upper platen 14 is then lowered and indexed into proper engagement and position above the product to thereby confine it in a predetermined and well-defined volume and configuration. Loading assembly 16 thereafter functions to engage the ends of the confined spaghetti or other product and push it into the awaiting aligned carton 18. In order to accomplish this result efficiently, loading assembly 16 cooperates with bucket structure 12 and platen 14 in a self-aligning manner, so that none of the product escape from the bucket in the transferring of the product from the bucket into the carton.

Figure 15:
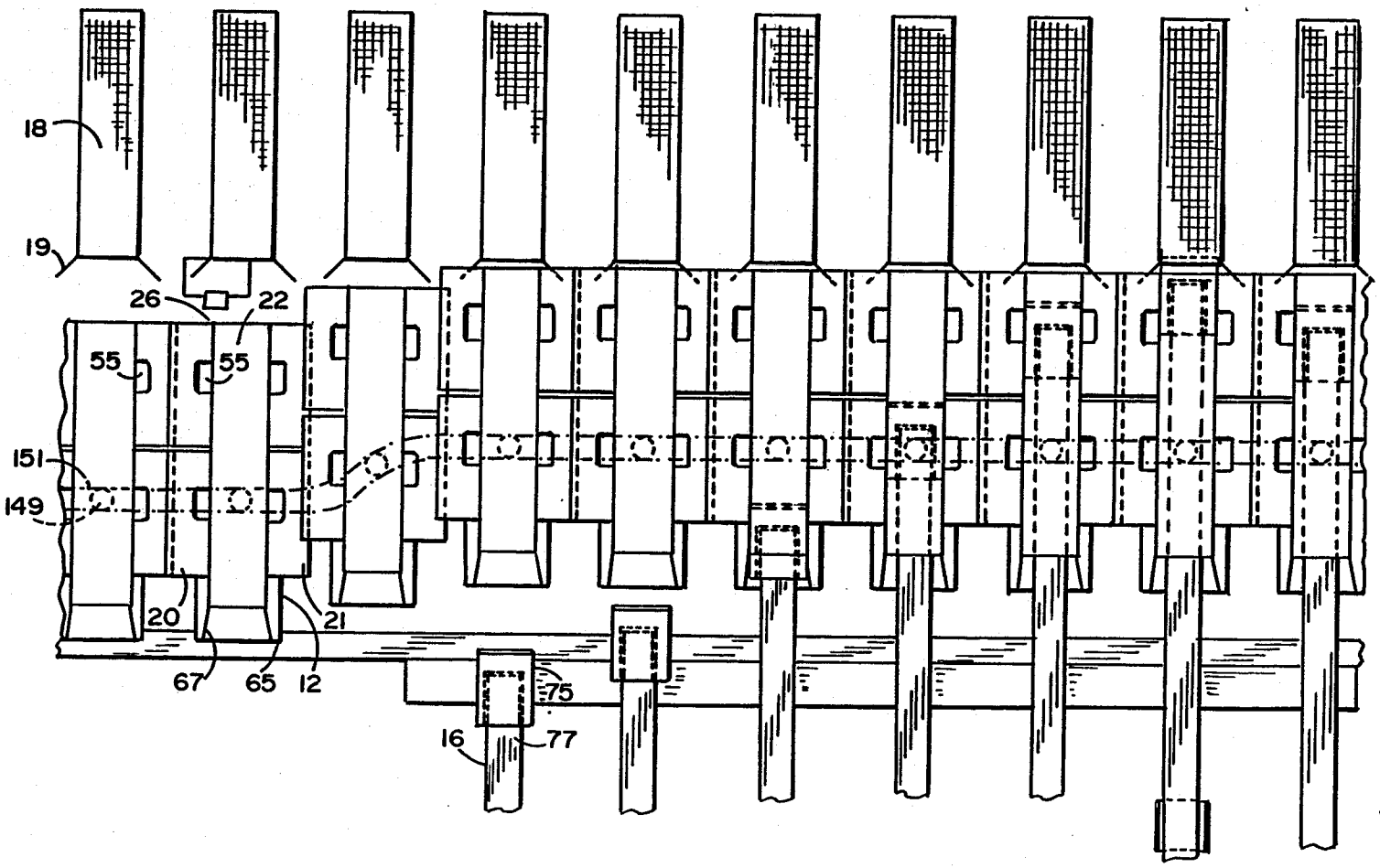
FIG. 15 is a top plan view of the cartoning apparatus.

All of these elements are assembled together in an assembly line style conveyorized operation; that is, a conveyorized system of bucket structures 12, platens 14, loading assemblies 16 and cartons 18 are all aligned and moved along a predetermined path as they interact in the cartoning procedure (FIG. 15). Typically, the elements are continually moved through the use of endless chain drives 125, 126, 127, 128. While such a dynamic system increases the speed and efficiency of the cartoning process over a static one, it also has been one of the major difficulties to fabricating an effective cartoning device for loose media such as spaghetti. The use of such interlocking pieces requires that they be machined with very close tolerances to prevent the escapement of product from the bucket and/or outside the carton silhouette during loading. However, the consistent alignment of the interacting parts, having such close tolerances, as they are moved along their predetermined path, has heretofore not been seen as practical, and has not been accomplished because of stretching of the conveyor chains over time. Hence, past artisans have had to rely upon the earlier discussed matching sets.

Figure 8:
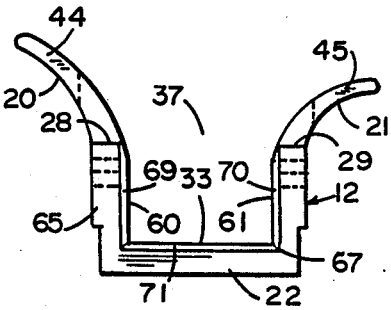
FIG. 8 is a rear view of bucket structure 12.
Figure 9:
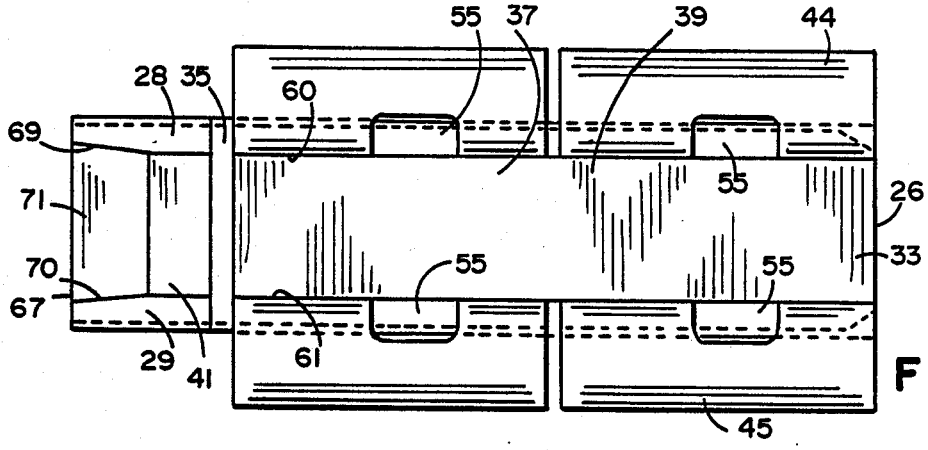
FIG. 9 is a top plan view of the bucket structure with the gate in position.
Figure 10:
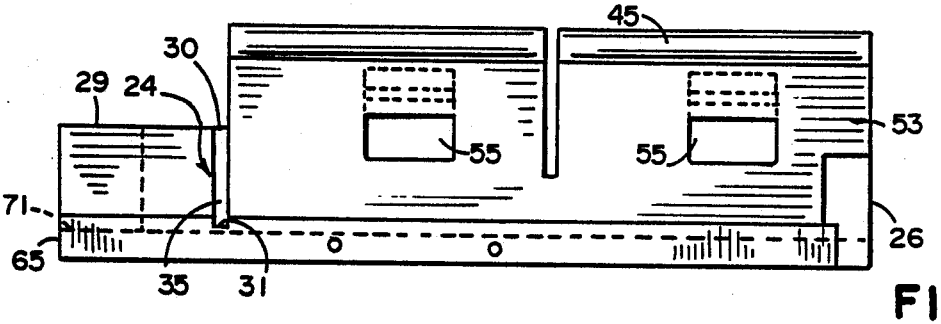
FIG. 10 is a side elevational view of the bucket structure with the gate in position.
Figure 13:
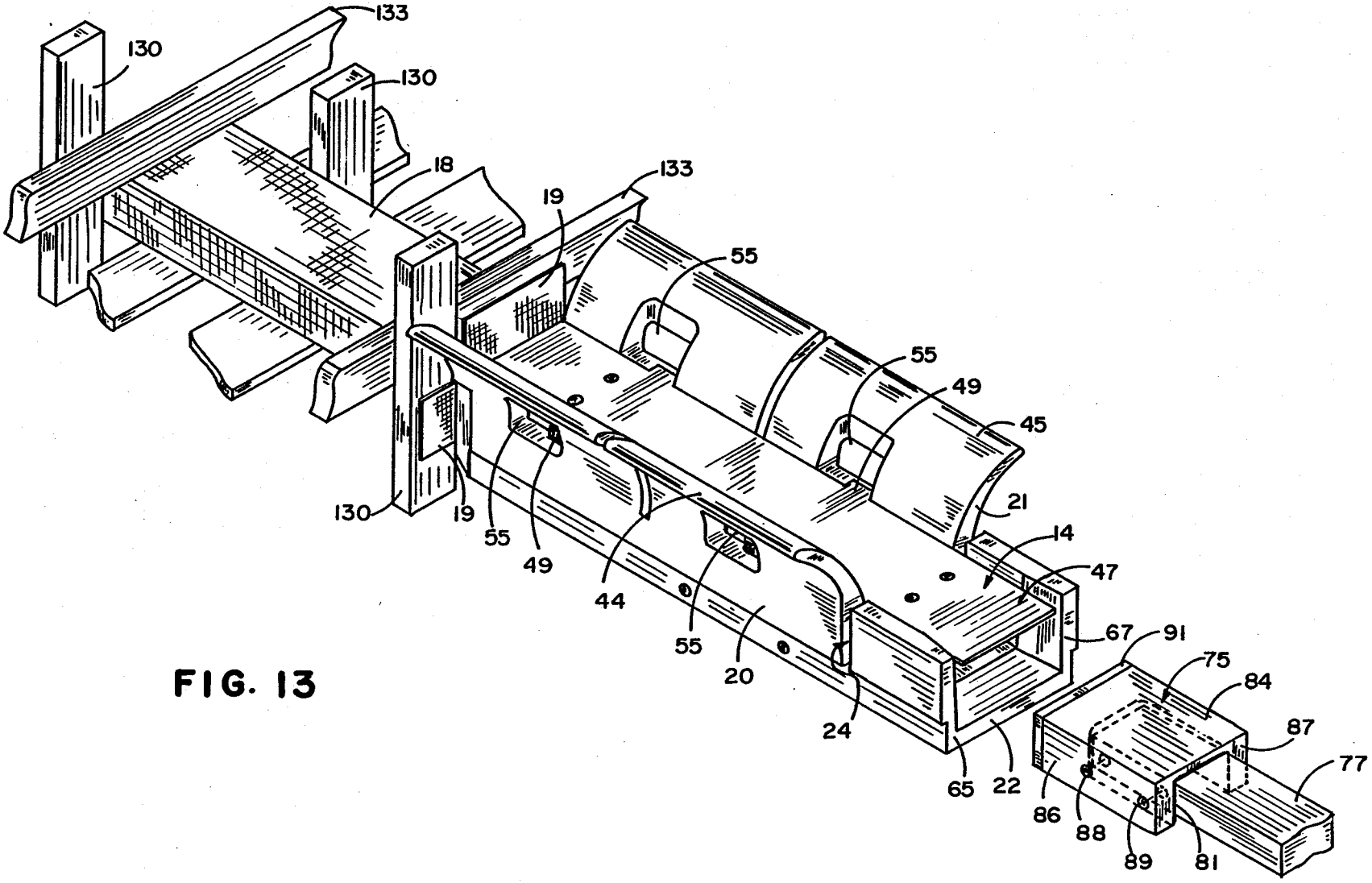
FIG. 13 is a perspective view of a loading assembly, bucket structure, platen and carton all aligned for transferring the products into the carton.

The preferred bucket structure 12 is of a substantially open-top channel configuration which includes a pair of upstanding legs 20, 21 and an inner connecting base 22 (FIGS. 8–10). Legs 20, 21 define therebetween a cavity 37 which is moved into alignment with an open carton 18. As seen in FIG. 13, the open end of carton 18 during the loading product therein is positioned close to the end of bucket structure 12 and held in position by a plurality of stop members such as flights 130 and an upper beam or rail 133 which is disposed over the entire path that each carton 18 travels after it has been opened and squared into useful configuration (by known equipment, not shown). Also note that, typically, flaps 19 of carton 18 will be disposed along the sides of bucket legs 20, 21.

Near the rearward end 65 of each leg 20, 21 is provided a vertical slot 24. Slots 24 pass completely through each leg 20 and extend from an open end 30 at upper edges 28, 29 of legs 20, 21 to an end wall 31 which is flush with top surface 33 of base 22. Slots 24 are aligned with each other to facilitate the receipt of gate or partition member 35 therein (FIGS. 9 and 10). Gate 35 essentially consists of a plate member which forms a barrier across cavity 37, defined between legs 20, 21, and partitions bucket structure 12 into forward and rearward sections 39, 41. Forward section 39 is dimensioned and adapted to receive therein a proper apportionment of the product to be inserted into the carton. Preferably, the product is fed into bucket structure 12 in a generally downwardly and rearwardly direction such that its ends abut and generally align themselves along gate 35, whereby the product is preliminarily arranged in a reasonably uniform and regular array. Thereafter, gate 35 is removed from cavity 37. The mechanism for moving gate 35 may be of any known type.

To further enhance the feeding of the product into cavity 37 of bucket structure 12, legs 20, 21 are curved arcuately outwardly at their upper ends 44, 45 (FIG. 8). This construction creates a funnelling effect so that the product may be fed into a given bucket structure with less than precise alignment but still without the risk of spilling the product out of the adjacent buckets. Furthermore, one of the legs 21 is preferably curved outwardly at a lower elevation than the other leg 20. As clearly seen in FIG. 1, this results in the overlapping of adjacent legs 21, 20' from adjacent bucket structures 12, 12', in order to ensure that none of the product escapes out between buckets 12 during the feeding operation.

Along with moving along the predetermined path parallel to carton 18, bucket structure 12 also moves laterally thereof during the cartoning procedure so that it lies directly adjacent to the open end of carton 18. Initially, to accommodate the carton opening equipment, bucket structure 12 is spaced from carton 18. However, after the carton-opening equipment has been withdrawn from the predetermined path, bucket structure 12 is moved toward carton 18 to thereby eliminate the existing gap.

Figure 14:
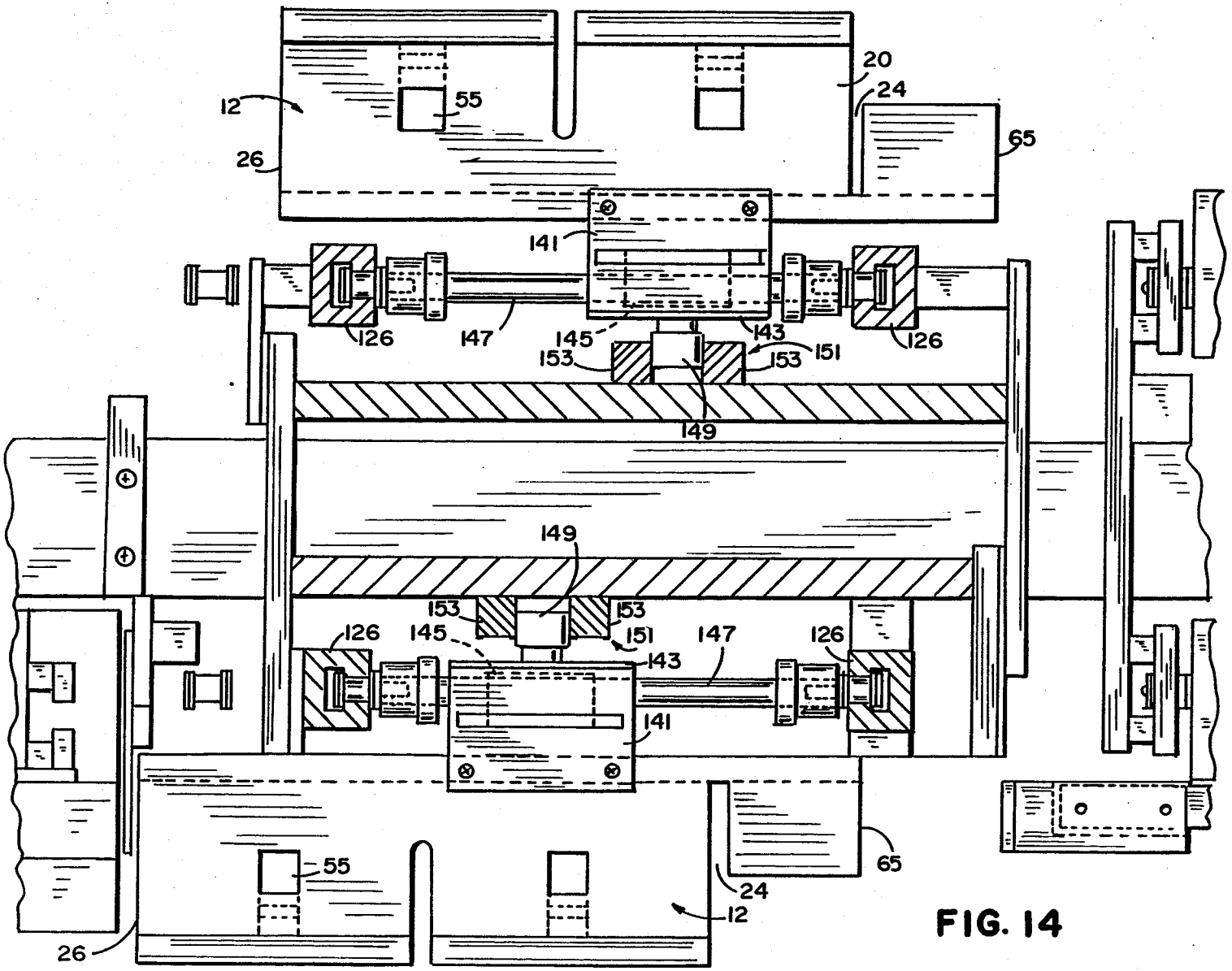
FIG. 14 is a cross-sectional view of the bucket structure portion of the apparatus.

More specifically, as seen in FIG. 14, bucket structure 12 is mounted to a bracket 141. Bracket 141 is fixedly attached at its upper end to bucket structure 12 by any known means. The lower end of bracket 141 is provided with a pair of parallel bores 143 extending therethrough. In each bore 143 is provided a linear bearing 145 which slidingly receives therethrough a rod or shaft 147. Two parallel rods 147 are provided to reduce the possibility of any twisting or rocking which the bucket structure 12 may experience. Each end of rod 147 is attached by an adapter link 157 to the chain drive 126. Rods 147, in the preferred embodiment, are spaced approximately three links apart. Of course, a variety of different spacings could be utilized. One end of the adapter link 157 is fixedly mounted to a corresponding link of chain drive 126. The other end of the adapter link 157 is mounted in an elongated opening which allows the adapter link 157 to move with respect to the chain link. This construction accommodates the travel of the chain over the end sprockets (not shown).

Projecting below bracket 141 is a cam follower 149 which is received in a cam track 151. Cam track 151 is preferably formed by a pair of rails or tracks 153 which are spaced apart to matingly receive cam follower 149. As seen in FIG. 15, cam track 151 is provided with a bend to effectuate the moving of bucket structure 12 toward carton 18; that is, as cam follower 149 follows the bend in cam track 151 bracket 141 travels along rods 147 and thereby moves bucket structure 12 laterally of the predetermined parallel path. Further, as seen in FIG. 14, cam track 151 is also present on the return path so that no drifting of bucket structure 12 occurs.

Figure 1:
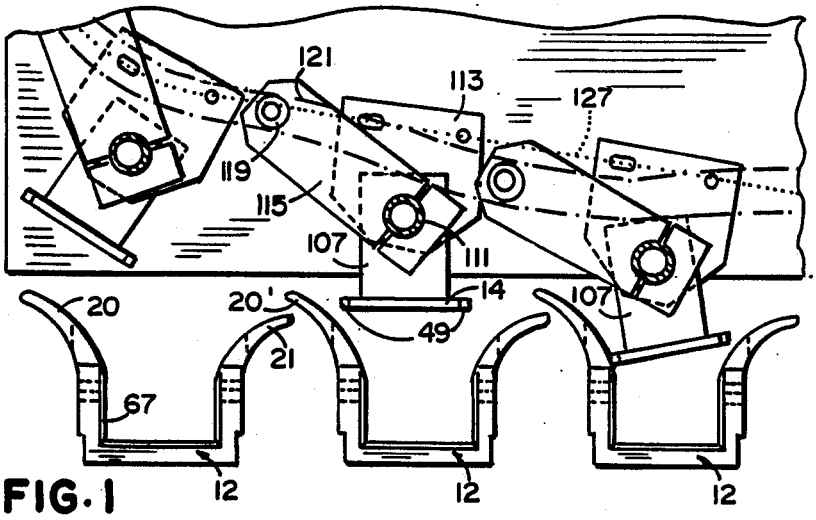
FIG. 1 is a side elevational view of upper platens being lowered onto bucket structures of the present invention.
Figure 2:
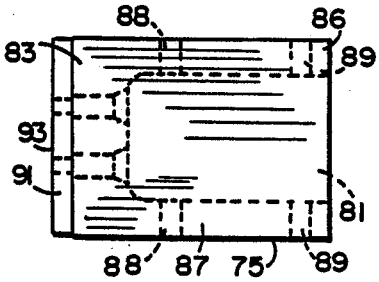
FIG. 2 is a top plan view of the pusher foot of the present invention.
Figure 3:
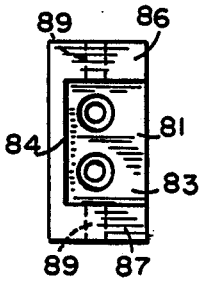
FIG. 3 is a rear view of the pusher foot.
Figure 5:
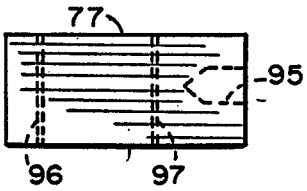
FIG. 5 is a top plan view of the connector of the present invention.
Figure 4:
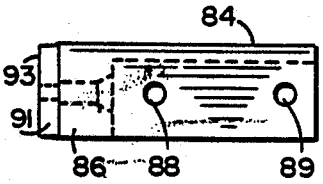
FIG. 4 is a side elevational view of the pusher foot.
Figure 6:
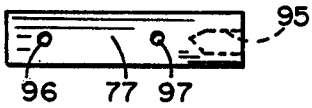
FIG. 6 is a side elevational of the connector.
Figure 7:
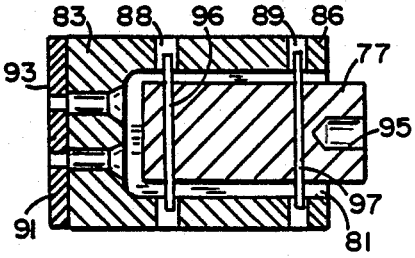
FIG. 7 is a cross-sectional view of the pusher foot and connector in their assembled state.

To contain the product fed into each bucket structure 12, an upper platen or "confinement paddle" 14 is lowered downwardly to engage the upper rows of the spaghetti (FIG. 1). When cartoning a loose product such as spaghetti, platen 14 functions as a confining and retaining structure such that only a slight reduction in volume may be experienced by the overall charge of spaghetti. More specifically, lower face 46 of platen 14 is positioned immediately below the top wall of the carton, and acts as an effective barrier so that no spaghetti may raise above that point. There may, of course, be some products wherein a substantial compression by platen 14 may be appropriated.

Figure 11:
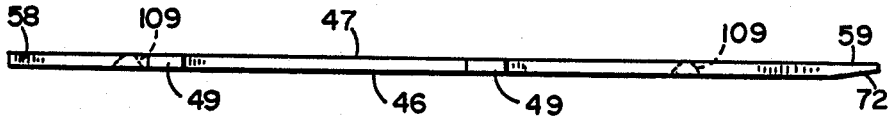
FIG. 11 is a side elevational view of the upper platen of the present invention.
Figure 12:
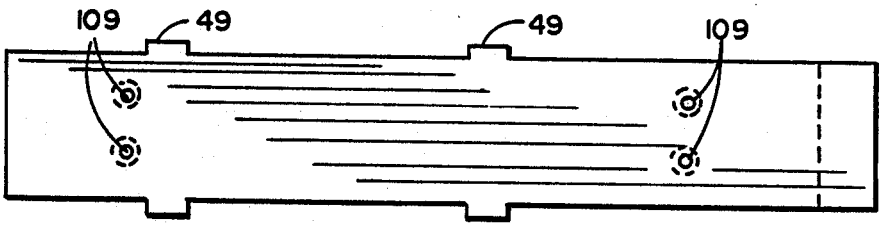
FIG. 12 is a top plan view of the upper platen.

Platen 14 is comprised of an elongated body 47 which is preferably constructed as a long, narrow plate member which may or may not have a plurality of outwardly extending indexing ears 49 (FIGS. 11 and 12). Indexing ears 49, when utilized, are provided on body 47 to interact and mount platen 14 in a predetermined position on bucket structure 12. Body 47 is therefore dimensioned to be matingly received within cavity 37 and thereby form the upper barrier for the volume of the product. Ears 49 typically are structured to lie within the same plane as body 47 and are arranged in sets 51 which consist of a pair of aligned ears 49 extending in opposite directions. In the illustrated embodiment, two spaced apart sets 51 are provided along the length of body 47.

Along a medial portion 53 of legs 20, 21 are provided a plurality of indexing notches 55. Notches 55 are shaped to matingly receive therein indexing ears 49 of upper platen 14. This interlocking construction serves to precisely position platen 14 in a predetermined elevational and longitudinal orientation. More specifically, as described above, platen 14 is positioned such that the product is contained vertically so that it cannot raise above the top surface of carton 18. Also, body 47 is positioned longitudinally so that ends 58, 59 thereof are aligned with ends 26, 65 of bucket structure 12.

As illustrated in FIG. 1, each of the various upper platens 14 is lowered into position on one of the bucket structures 12 through cooperation with an endless chain drive. More specifically, each platen 14 is attached to a mounting block 107 which is disposed orthogonally to and projects outwardly from platen 14, and which is fixedly mounted to a rotatable guide shaft 111. Preferably, mounting block 107 consists of two portions which are bolted together to thereby fixedly journal the mounting block on guide shaft 111. Of course, any known means of mounting could be utilized. Guide shaft 111 is movably coupled to the aforementioned endless chain drive through the use of a pair of suspension plates 113, 115. Suspension plate 113 positions guide shaft 111 at a predetermined spacing from the chain drive, and rotatingly supports guide shaft 111 so that upper platen 14 may be swung into its proper position as it is moved along by the chain drive 127. Suspension plate 115 cooperates with suspension plate 113 to thereby control the orientation of platen 14. At one end of suspension plate 115 is provided a cam follower 119 which is matingly received within cam track 121. As seen in FIG. 1, cam track 121 follows a predetermined path which is different than chain drive 127. The other end of suspension plate 115 is fixedly attached to guide shaft 111; preferably by bolting as was discussed with mounting block 107. Hence, as chain drive 127 moves suspension plate 113 along its predetermined path, it operates to lower guide shaft 111 toward bucket structure 12. As guide shaft 111 is moved along the predetermined path and downwardly toward bucket structure 12, suspension plate 115 is moved along cam track 121. As cam track 121 moves cam follower 119 upwardly and downwardly, it results in rotating guide shaft 111 and hence platen 14 (FIG. 1). Hence, as the chain drive moves through its predetermined path, suspension plates 113, 115 and the other parts of the mechanism just described cooperate to lower and swing each platen 14 through a complex series of motions into its proper position relative to the corresponding bucket structure 12, so that indexing ears 49 will be received within indexing notches 55. In so doing, it will be noted that the trailing edge of each such platen closely approaches and moves along the trailing curved side 20 of its aligned bucket 12, moving into position angularly at first and then ultimately parallel with the bottom of the bucket and perpendicular with its sides. This path of movement helps prevent the escapement of the loose media (and particularly the long, thin vermicelli) out of the bucket while it is being confined into the desired cross-sectional envelope for loading into the carton.

Once platen 14 has been so lowered into position, the spaghetti or other loose media is contained within a defined box-like containment structure; that is, the product is contained peripherally within bucket 12 between top surface 33 of base 22, vertical inner sidewalls 60, 61 of legs 20, 21, and under bottom surface 46 of upper platen 14.

Rearward section 41 of bucket structure 12 is of a substantially different configuration from forward section 39 (FIG. 9 and 10). Since rearward section 41 is not designed to receive therein any of the product during the feeding operation, the upper outwardly extending curved portions 44, 45 of legs 20, 21 are eliminated. Also, bucket structure 12 in conjunction with upper platen 14 defines a rectangular funnel structure 67. This construction expands cavity 37 slightly at rearward end 65 so that loading assembly 16 may be self-aligned to be easily received therein.

More particularly, top surface 33 and inner vertical sidewalls 60, 61, at rearward end 65 of bucket structure 12, are each provided with similarly tapered planar surfaces 69, 70, 71, respectively, which are all inclined outwardly at a gradual slope, for example on the order of five degrees. In cooperation therewith, bottom surface 46 of platen 14 is also provided with a tapered planar surface 72 which when interlocked with bucket structure 12 is also inclined outwardly from the box-like containment structure at the same gradual slope to thereby also act to further expand cavity 37.

Loading assembly 16 (FIGS. 2–7) also moves along a predetermined parallel path through the use of chain drive 125, and includes a pusher foot 75 and a connecting box 77 which is operatively coupled to a reciprocating actuator 79. The actuator 79 may be powered by any known device, such as a fluid or mechanically powered arrangement and acts to transfer the product out of bucket structure 12 and into the aligned carton 18. Pusher foot 75 is movably mounted upon connector 77 to facilitate a universal freedom of movement therefor. This "floating" type of coupling permits pusher foot 75 to follow the angularly-converging sides of funnel structure 67, so that the pusher foot is in effect self-aligning with respect to cavity 37.

More specifically, pusher foot 75 (FIGS. 2–4) is preferably in the form of a hollow block having a recess 81 which opens rearwardly. Recess 81 is bounded by a forward wall 83, a pair of opposing sidewalls 86–87, and at least an upper wall 84. Passing through sidewalls 86, 87 are a pair of spaced apart, parallel bores 88, 89. An engagement plate 91 is fixedly attached to forward wall 83 and includes a forward engagement face 93 adapted to engage and push the collected loose product into the carton. Engagement plate 91, then, compensates for the abrasive effect that is invariably encountered in such a loading operation and is particularly true of the sharp ends of the spaghetti which it must engage and push against. Furthermore, engagement plate 91 is only slightly smaller (i.e. a distance less than the diameter of a spaghetti strand) than cavity 37, to ensure that no strands may escape between the bucket structure 12, platen 14 and pusher foot 75 as the latter is passed through the bucket cavity 37.

Connector 77 (FIGS. 5 and 6) is fixedly attached to actuator 79 and facilitates the movable coupling of pusher foot 75 thereto. Connector 77 also has a block configuration, but is of a reduced size as compared to recess 81, such that the connector is loosely received within such recess. In the example shown, connector 77 is provided with a threaded bore 95 which is adapted to threadedly receive therein the distal end of actuator 79 for attachment purposes although any known construction may be utilized. Extending completely through connector 77 horizontally are a pair of holes 96, 97 which have the same spacing as bores 88, 89 so that they may be aligned therewith. Note however, that holes 96, 97 have a significantly smaller diameter than bores 88, 89.

Pusher foot 75 is movably coupled to connector 77 by a pair of elongate pins 102, 103 which are fixedly mounted in holes 96, 97 and project outwardly from each end of connector 77, so that they are received within bores 88, 89 of both sidewalls 86, 87. Pins 102, 103 are constructed with the same diameter as holes 96, 97, and are therefore loosely received within the larger bores 88, 89. Also, pins 102, 103 project sufficiently from each side of connector 77 so that they may not be removed from bores 88, 89 of either upper or lower walls 86, 87. This sturdy, uncomplicated connection facilitates the three-dimensional freedom of movement required for pusher foot 75 to align itself with cavity 37 and perform the desired loading operation.

Consequently, since recess 81 is provided with a larger length, width and depth than connector 77, and since bores 88, 89 are enlarged relative to pins 102, 103 received therein, pusher foot 75 is not precluded from shifting relative to connector 77 and may be translated in any direction. Moreover, the freedom of movement facilitated by such a coupling also permits pusher foot 75 to be tilted in any direction relative to connector 77. Note however, that all of such allowable motion is limited to a specified amount due to the small clearance between the walls of recess 81 and connector 77, and the sidewalls of bores 88, 89 and pins 102, 103.

In operation (FIGS. 1, 13 and 14), as discussed above, carton 18, bucket structure 12, upper platen 14 and loading assembly 16 are all moved together along a predetermined path at the same rate and in the same direction. Initially, gate 35 is received within slot 24 to thereby partition cavity 37 into a forward section 39 and a rearward section 41. The spaghetti, vermicelli or other loose product is then fed into bucket structure 12 in a generally downwardly and rearwardly direction so that its ends generally abut against and become aligned behind gate 35; of course, gate 35 also precludes any of the loose media from entering the rectangularly funnelled pusher foot alignment chamber 67. Once all the product has been fed into cavity 37, gate 35 is removed and bucket structure 12 is moved by cam track 151 to a position directly adjacent the open end of carton 18. Thereafter, upper platen 14 is lowered into position, such that indexing ears 49 are received within the two corresponding openings 55 provided in sides 20, 21. This positive, indexing structural arrangement precisely maintains the upper levels of the media (spaghetti) just below the top surface of carton 18, and ensures that the cross-sectional area occupied by the media is at least slightly smaller than the end opening of the carton to be filled.

Once platen 14 has been securely positioned, pusher foot 75 is driven forwardly toward funnel structure 67 by actuator 79. When pusher foot 75 reaches funnel structure 67, if it is not already in perfect alignment with cavity 37 (as it is unlikely to be), the pusher foot will engage one of the tapered surfaces 69–72 and be shifted into aligned position due to the universal connection with connector 77. Engagement plate 91 will then ride along the one or more tapered surfaces 69–72 as it is driven forward by actuator 79, until engagement plate 91 comes into perfect alignment with, and is matingly received within cavity 37.

At this point, pusher foot 75 is extended onward through cavity 37 so that engagement face 93 abuts the adjacent ends of the loose media and pushes it quickly, efficiently and easily into the aligned carton 18. Upon completion of loading operation, actuator 79 withdraws pusher foot 75 from cavity 37 and upper platen 14 is lifted off bucket 12 for its subsequent travel to the beginning of another operation.

Of course, it is understood that the above descriptions are those of preferred embodiments of the invention. Various other embodiments as well as many changes and alterations, may be made without departing from the spirit and broader aspects of the invention as defined in the claims.

The embodiments of the invention in which an exclusive property or privilege is claimed are defined as follows:

1. A cartoning apparatus for loading loose media into a carton, wherein said apparatus comprises:

a bucket structure having forward and rearward ends and defining a cavity adapted to receive therein the loose media, said rearward end having at least certain diverging wall portions defining an outwardly-opening funnel-like structure;

an actuator for providing reciprocal motion; and a loading member adapted to be matingly received into said cavity, and means for movably coupling said loading member to said actuator for at least limited lateral lost motion with respect thereto, whereby said loading member may cooperate with said funnel-like structure by following along the surface of at least one of said diverging wall portions and shifting into mating alignment with said cavity prior to passing longitudinally therethrough to thereby push said loose media out of said bucket structure and into an aligned carton.

2. The cartoning apparatus of claim 1 further including means for moving said bucket structure, said loading member, and said carton all along a predetermined path at the same effective rate and direction during said shifting of position by said loading member and said longitudinal passing thereof.

3. The cartoning apparatus of claim 1 further including means mounting said bucket structure for bidirectional longitudinal movement along an axis extending through said forward and rearward ends, and means for moving said bucket structure along said axis and toward said aligned carton in synchronism with the reciprocal motion of said loading member.

4. The cartoning apparatus of claim 1 further including:

a platen and means for removably mounting same on said bucket structure in a position to overlie said cavity and thereby define a laterally-enclosed box-like construction which contains the loose media during the movement of said loading member such that the media is maintained within the cross-sectional silhouette of said carton whereby said media may be pushed into said carton without interference by the carton.

5. The cartoning apparatus of claim 4 further including means for moving said bucket structure, said platen, said loading member and said carton all along a predetermined path at the same effective rate and direction during the pushing operation of said loading member.

6. The cartoning apparatus of claim 4, further including means mounting said bucket structure for bidirectional longitudinal movement along an axis extending through said forward and rearward ends, and means for moving said bucket structure along said axis and toward said aligned carton in synchronism with the reciprocal motion of said loading member.

7. The cartoning apparatus of claim 5 further including means for coupling said platen to said means for moving wherein said coupling means includes a mounting member, a guide shaft, and first and second cooperating structures;

said first cooperating structure being attached to said moving means to rotatingly support said guide shaft, whereby said shaft is held in a predetermined spacing from said moving means;

said second cooperating structure being pivotally attached to said moving means and fixedly connected to said guide shaft, whereby said guide shaft is rotated in a controlled predetermined manner; and said mounting member being fixedly attached to said guide shaft and said platen, whereby said platen is lowered and swung into position on said bucket structure as said moving means moves said platen and said bucket structure along said path.

8. The cartoning apparatus of claim 4 in which said platen includes a plurality of projecting indexing portions and said bucket structure includes a plurality of corresponding indexing recesses to matingly receive therein said projecting portion and thereby precisely position said platen in predetermined position to confine said media to a specific cross-sectional area within said bucket structure.

9. The cartoning apparatus of claim 4 in which said funnel-like structure is formed by an outwardly tapering surface provided on said platen and on the peripheral walls of said bucket structure.

10. The cartoning apparatus of claim 9 in which said means for mounting said loading member includes:

a connector fixedly attached to said actuator and having a defined height, width and depth;

a pair of mutually-aligned pin members carried on said connector and extending from opposing sides thereof; and a pusher element movably coupled to said connector and having a rearwardly-opening recess with a defined height, width and depth which is larger than said height, width and depth of said connector, said recess being bounded by a pair of opposing walls each having an opening of greater transverse dimension than that of said pin members, said pin members being received within said openings whereby said connector is movably received within said recess and said pin members are loosely received within said openings such that said pusher element may be shifted in three directions to align and be matingly received within said cavity.

11. The cartoning apparatus of claim 10 in which said pusher element further includes an outer engagement plate adapted to contact and push against the loose media when it is moved into the aligned carton.

12. The cartoning apparatus of claim 11 further including means for moving said bucket structure, said platen, said loading member and said carton all along a predetermined path at the same effective rate and direction during the pushing operation of said loading member.

13. The cartoning apparatus of claim 12, further including means mounting said bucket structure for bidirectional longitudinal movement along an axis extending through said forward and rearward ends, and means for moving said bucket structure along said axis and toward said aligned carton in synchronism with the reciprocal motion of said loading member.

14. The cartoning apparatus of claim 12 further including means for coupling said platen to said means for moving wherein said coupling means includes a mounting member, a guide shaft, and first and second cooperating structures;

said first cooperating structure being attached to said moving means to rotatingly support said guide shaft, whereby said shaft is held in a predetermined spacing from said moving means;

said second structure being pivotally attached to said moving means and fixedly connected to said guide shaft, whereby said guide shaft is rotated in a controlled predetermined manner; and said mounting member is fixedly attached to said guide shaft and said platen, whereby said platen is lowered and swung into position on said bucket structure as said moving means moves said platen and said bucket structure along said path.

15. The cartoning apparatus of claim 1 in which said means for mounting said loading member includes:

a connector fixedly attached to said actuator and having a defined height, width and depth;

a pair of mutually-aligned pin members carried on said connector and extending from opposing sides thereof; and a pusher element movably coupled to said connector and having a rearwardly-opening recess with a defined height, width and depth which is larger than said height, width and depth of said connector, said recess being bounded by a pair of opposing walls each having an opening of greater transverse dimension than that of said pin members, said pin members being received within said openings whereby said connector is movably received within said recess and said pin members are loosely received within said openings such that said pusher element may be shifted in three directions to align and be matingly received within said cavity.

16. The cartoning apparatus of claim 1 further including a slot provided in said bucket structure, a partition member receivable within said slot, and means for removably and so positioning said partition member across said cavity when said loose media is fed into said cavity, whereby said partition acts as a barrier during such feeding of media.

17. A method of loading loose media into a carton, comprising the steps:

providing a bucket structure having a cavity and forward and rearward ends, said rearward end having at least certain tapering wall surfaces defining an outwardly-diverging opening;

providing an actuator and a loading member whose cross-sectional size and shape closely approaches that of said cavity, said loading member being movably mounted to said actuator;

feeding said loose media into said bucket structure;

moving said loading member by said actuator toward said outwardly-diverging end opening of said bucket structure and along at least one of said wall surfaces such that said loading member follows said surfaces and is shifted thereby into alignment with said cavity, to be closely received therein; and passing said loading member through said cavity to push said media out of said bucket structure and into an aligned carton.

18. The method of claim 17 and including the steps of providing a movable partition member for said bucket structure and adapting such partition member and bucket structure such that the partition member is removably received across the width of said bucket structure cavity;

placing said partition member across said bucket structure cavity before said media is fed into said bucket structure;

feeding said media into said bucket structure cavity such that it substantially engages and is aligned along said partition member; and removing said partition member from said bucket structure before said loading member is passed therethrough to load said media into an aligned carton.

19. The method of claim 17, and including the steps:

providing a bucket structure which is bidirectionally movable longitudinally between said loading member and said aligned carton, and moving said bucket structure toward said aligned carton in synchronism with the moving of said loading member by said actuator.

20. The method of claim 19, and including the steps:

providing a platen for closing said cavity from the top, and placing said platen on said bucket structure after said media has been fed into said cavity to thereby confine said media within said cavity; and moving said loading member toward said bucket member and through said cavity to push said media out of said bucket structure and into the aligned carton.

21. The method of claim 20 and including the steps of providing a movable partition member for said bucket structure and adapting such partition member and bucket structure such that the partition member is removably received across the width of said bucket structure cavity.

22. The method of claim 21 in which said platen is indexed in a predetermined position on said bucket structure when it is placed thereon, such that said platen maintains said media within a predetermined cross-sectional area within said bucket structure cavity.

* * * * *